United States Patent [19]

Karls

[11] Patent Number: 4,832,640

[45] Date of Patent: May 23, 1989

[54] MARINE GEARCASE WATER INLET DIVIDER

[75] Inventor: Michael A. Karls, Hilbert, Wis.

[73] Assignee: Brunswick Corporation, Skokie, Ill.

[21] Appl. No.: 215,063

[22] Filed: Jul. 5, 1988

[51] Int. Cl.[4] ..... B63H 21/10

[52] U.S. Cl. ..... 440/88

[58] Field of Search ..... 440/76, 78, 88, 89, 440/900; 123/41.01, 195 P; 415/141

[56] References Cited

U.S. PATENT DOCUMENTS

| | | | |
|---|---|---|---|
| 4,392,779 | 7/1983 | Bloemers et al. | 415/141 |
| 4,636,175 | 1/1987 | Frazzell et al. | 440/88 |
| 4,752,257 | 6/1988 | Karls et al. | 440/88 |

FOREIGN PATENT DOCUMENTS

| | | | |
|---|---|---|---|
| 30691 | 2/1982 | Japan | 440/88 |

*Primary Examiner*—Joseph F. Peters, Jr.
*Assistant Examiner*—Jesus D. Sotelo
*Attorney, Agent, or Firm*—Andrus, Sceales, Starke & Sawall

[57] ABSTRACT

In a marine propulsion unit (10) having a depending gearcase (20) having right and left sets of water inlet openings (32, 34) supplying cooling sea water to an upwardly extending water passage (30), a dividing wall (60) is provided in the water passage and has a top (62) extending substantially above the topmost water inlet openings (**32*a*, 34*a***) and directing water flow from each set of inlet openings upwardly and allowing such water flow from each set to merge only at a point spaced substantially above the topmost water inlet openings, to prevent cross-over in the water passage.

6 Claims, 3 Drawing Sheets

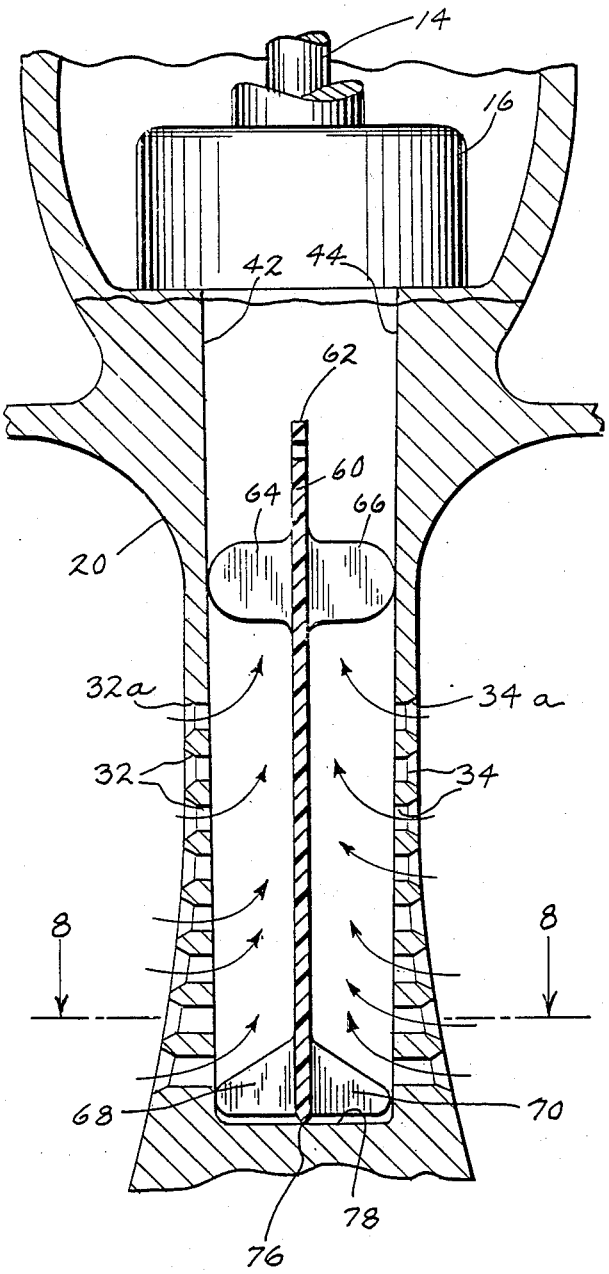
FIG. 7
FIG. 8
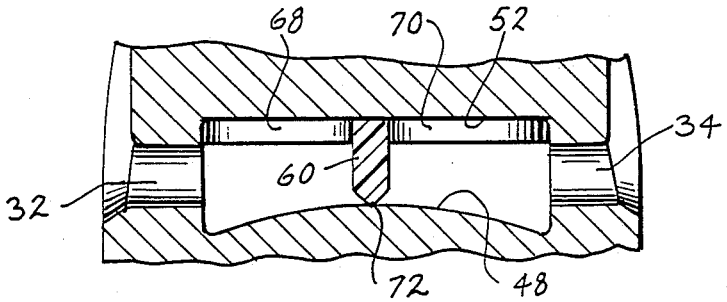

MARINE GEARCASE WATER INLET DIVIDER

BACKGROUND AND SUMMARY

The invention relates to a marine propulsion gearcase with water inlets and a water passage supplying cooling sea water to the water pump for cooling the engine.

As known in the art, water inlets are provided by holes or slots in the right and left sides of the gearcase and supply sea water to a vertical water passage which in turn supplies the water to the water pump thereabove. Turbulence caused by jets of water from inlet openings on one side of the gearcase can adversely affect performance of inlet openings on the other side of the gearcase. This is known as cross-over from side to side. For example, during a turn when one side of the gearcase is subjected to higher water pressure than the other side, water entering the high pressure water inlet side can be pulled out the other low pressure side. Also, when operating at less than fully submerged heights, there may be short circuited air flow cross-over.

The present invention provides a dividing wall in the water passage, which wall extends substantially above the topmost of the right and left water inlet openings and directs water flow from the openings upwardly and only allows merger of the water flow from the left and right sets of openings to join in the water passage at a point spaced substantially above the topmost of the water inlet openings.

BRIEF DESCRIPTION OF THE DRAWINGS

Prior Art

Present Invention

Figure 5:
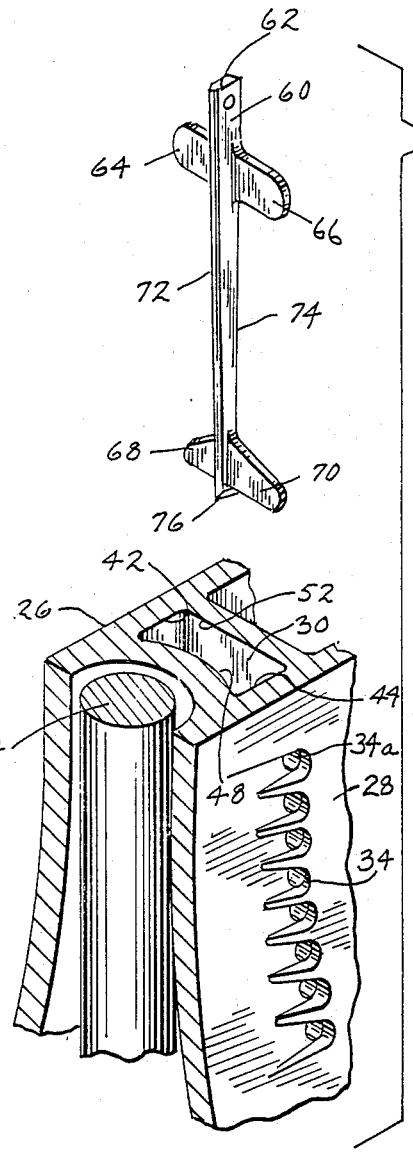

FIG. 5 is an isolated perspective view of marine gearcase water inlet structure, and a dividing wall in accordance with the invention.

Figure 6:
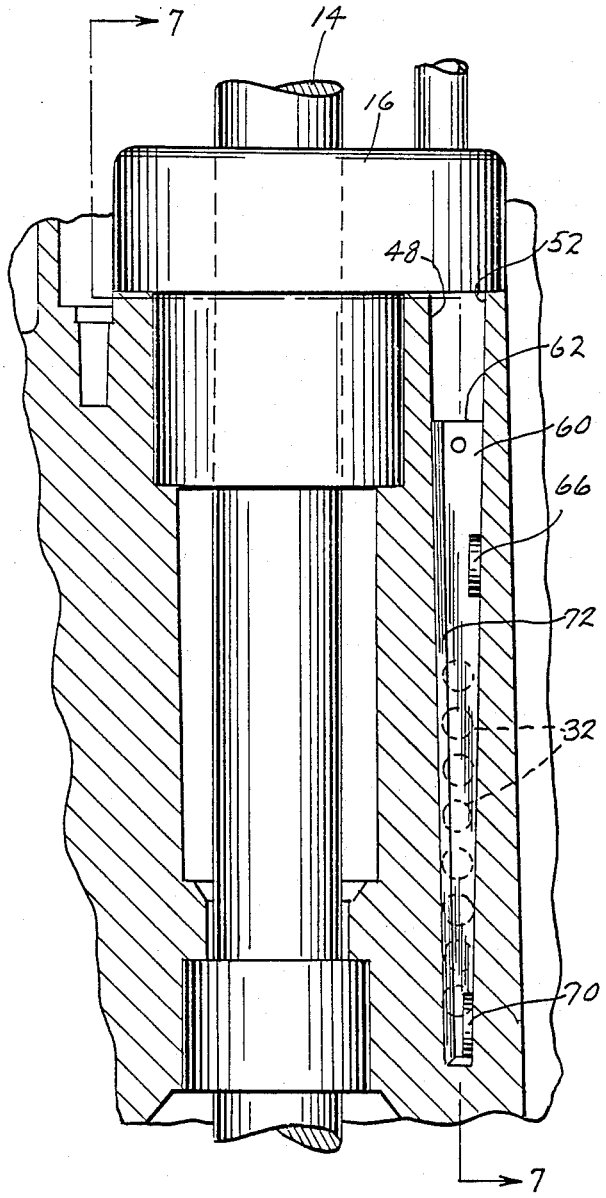

FIG. 6 is a sectional assembled view of the structure of FIG. 5.

FIG. 7 is a sectional view taken along line 7—7 of FIG. 6.

FIG. 8 is a sectional view taken along line 8—8 of FIG. 7.

DETAILED DESCRIPTION

Figure 1:
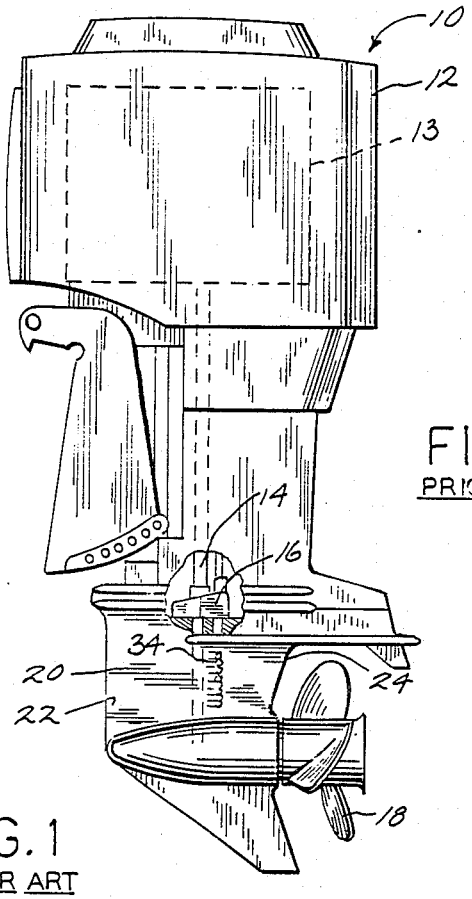
FIG. 1 PRIOR ART
FIG. 1 is a partially broken away side view of an outboard marine propulsion unit with depending gearcase, showing placement of water inlet openings.
Figure 3:
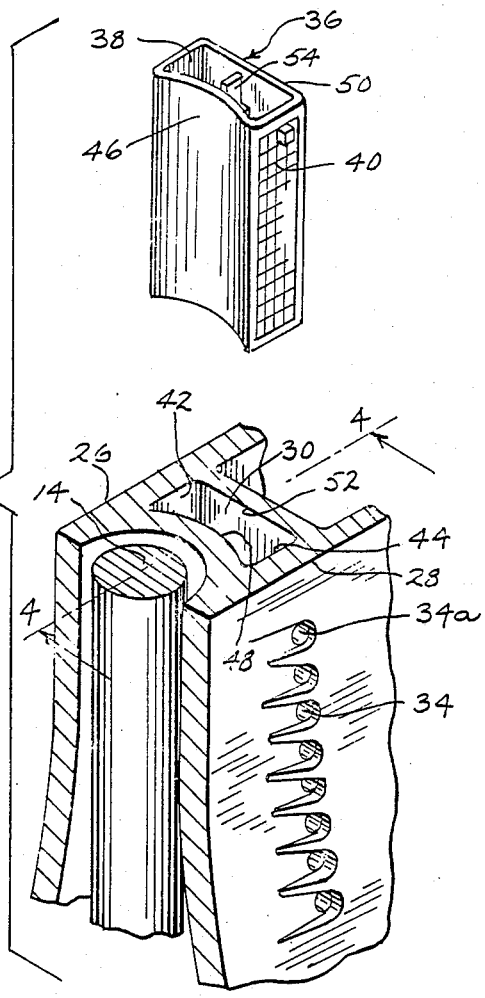
FIG. 3 PRIOR ART
FIG. 3 is an exploded perspective view of marine gearcase water inlet openings and mesh insert structure.
Figure 2:
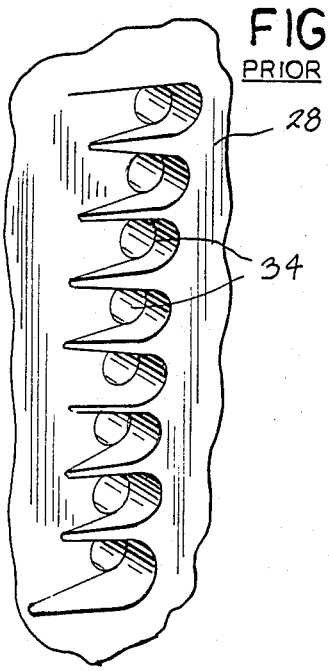
FIG. 2 PRIOR ART
FIG. 2 is an enlarged isolated perspective view of the marine gearcase water inlet openings of FIG. 1.
Figure 4:
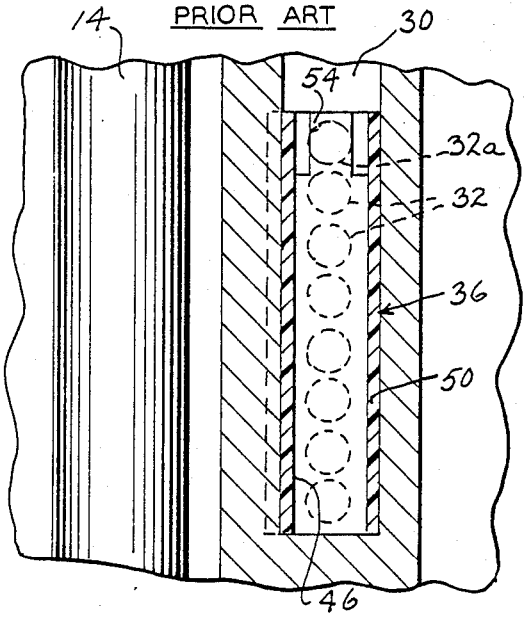
FIG. 4 PRIOR ART
FIG. 4 is a sectional view taken along line 4—4 of FIG. 3.

FIG. 1 shows an outboard marine propulsion unit 10, similarly to FIG. 1 in U.S. Pat. Nos. 4,392,779 and 4,752,257, incorporated herein by reference. Unit 10 includes a powerhead 12 with a liquid cooled internal combustion engine 13 powering drive shaft 14 and cooled by water supplied by pump 16. Rotation of drive shaft 14 drives propeller 18 and also drives water pump 16, as is known.

The marine propulsion unit has a depending gearcase 20 with a forward leading edge 22, a rearward trailing edge 24, and right and left sides 26 and 28 with a transverse water passage 30 therebetween which extends generally vertically upwardly and communicates with water pump 16 thereabove. The gearcase has a right set of one or more water inlet openings 32 on right side 26 communicating with water passage 30 for supplying sea water to water pump 16. The gearcase has a left set of one or more water inlet openings 34 on left side 28 communicating with water passage 30 for supplying sea water to water pump 16.

It is known to provide a plastic insert 36 in water passage 30. The insert has right and left screen or mesh type sides 38 and 40 engaging the right and left side walls 42 and 44 of water passage 30 and covering the inside of the water inlet openings 32 and 34 to keep debris out of water passage 30. The insert has a front arcuate wall 46 engaging the front arcuate wall 48 of water passage 30. The insert has a rear wall 50 engaging the rear wall 52 of water passage 30. A central wall 54 is between front wall 46 and rear wall 50 of the insert. Central wall 54 does not extend above the topmost water inlet openings **32*a* and 34*a***.

Present Invention

The present invention is shown in FIGS. 5–8, which use like reference numerals from FIGS. 1–4 where appropriate to facilitate clarity. An isolating dividing wall 60 is provided by an integral plastic member wedged and force fit into water passage 30. The dividing wall has a top 62 which extends substantially above the topmost water inlet openings **32*a* and 34*a*. The dividing wall directs water flow from each of the right and left sets of water inlet openings 32 and 34 upwardly and allows the water flow from each set to merge and join in water passage 30 only after it is substantially above the topmost water inlet openings 32*a* and 34*a*. This isolates each of the right and left sets of water inlet openings from transverse water flow from the other set such that turbulence caused by jets of water from inlet openings on one side do not adversely affect performance of inlet openings on the other side. During a turn when one side of the gearcase is subjected to higher water pressure than the other side, water entering the high pressure water inlet side is not pulled out the other low pressure side. The extension of the top 62 of the dividing wall above the topmost water inlet openings prevents transverse water flow across water passage 30 from one set of openings to the other set, and instead causes water from each set to flow upwardly in water passage 30. During high speed boat operation with higher gearcase heights on the transom, the upward extension of the top 62** of the dividing wall prevents short circuited air flow from aerated water through the topmost inlet openings, which in turn enables higher transom heights and in turn increased boat speed. This also reduces overheating problems.

Integral plastic dividing wall 60 has an integral upper right tab 64 extending laterally rightwardly from the dividing wall and engaging right side wall 42 of water passage 30. Dividing wall 60 has an integral upper left tab 66 extending laterally leftwardly from the dividing wall and engaging left side wall 44 of water passage 30. Dividing wall 60 has an integral lower right tab 68 extending laterally rightwardly from the dividing wall and engaging right side wall 42 of water passage 30. Dividing wall 60 has an integral lower left tab 70 extending laterally leftwardly from the dividing wall and engaging left side wall 44 of water passage 30. Dividing wall 60 is inserted downwardly into water passage 30, and tabs 64, 66, 68, 70 are force fit in the water passage to secure the dividing wall therein. Upper tabs 64 and 66 engage right and left side walls 42 and 44, respectively, above the topmost water inlet openings 32*a* and 34*a*, respectively.

Dividing wall 60 has a generally vertical leading edge 72 engaging front wall 48 of water passage 30, and a generally vertical trailing edge 74 engaging rear wall 52 of water passage 30. Front edge 72 tapers forwardly as it extends upwardly, to match the taper of water passage 30. Leading edge 72 has a V-shaped pointed configuration, FIG. 8, compressed against front wall 48 of water passage 30 and forming a seal therewith to provide the noted isolation between the right and left sets of water inlet openings 32 and 34. Dividing wall 60 has a lower edge 76 engaging the bottom wall 78, FIG. 7, of water passage 30. Lower edge 76 a V-shaped pointed configuration with a lower tip extending below lower tabs 68 and 70 and compressed against bottom wall 78 of the water passage and forming a seal therewith to provide the noted isolation between the right and left sets of water inlet openings 32 and 34.

Tabs 64, 66, 68, 70 locate and secure dividing wall 60 in water passage 30 and have minimum front to rear thickness to take up minimum space in water passage 30 and in turn have minimum affect on water flow. The tabs engage rear wall 52 of water passage 30, and are spaced rearwardly of front wall 48. In the preferred embodiment, the tabs and the noted V-shaped pointed edges of the dividing wall are the sole means securing the dividing wall in the water passage and provide minimum interference with water flow through the passage, though other securing means may be used.

It is recognized that various equivalents, alternatives and modifications are possible within the scope of the appended claims.

I claim:

1. A marine propulsion unit having an internal combustion engine and comprising a depending gearcase with a rear propeller, said gearcase having right and left sides, a right set of one or more water inlet openings in said right side of said gearcase, a left set of one or more water inlet openings in said left side of said gearcase, a water passage in said gearcase defined by right and left side walls through which said right and left sets of water inlet openings extend, respectively, front and back walls, and a bottom wall, said water passage supplying cooling sea water from said left and right sets of water inlet openings upwardly to a water pump, an isolating dividing wall in said water passage between said right and left sets of water inlet openings, said dividing wall having a top extending substantially above the topmost of said water inlet openings of each of said right and left sets and directing water flow from each set upwardly and allowing water flow from each set to merge and join in said water passage only when such flow is substantially above the topmost of said water inlet openings, whereafter said water flows to said water pump thereabove, said dividing wall isolating each of said right and left sets of water inlet openings from transverse flow from the other set, including the topmost said water inlet openings, such that turbulence caused by jets of water from inlet openings on one side do not adversely affect performance of inlet openings on the other side, and such that during a turn when one side of said gearcase is subjected to higher water pressure than the other side, water entering the high pressure water inlet side is not pulled out the other low pressure side, and such that during nonfully submerged operation with said topmost water inlet openings subject to aerated water, the extension of said top of said dividing wall above the topmost water inlet openings prevents transverse short circuited air flow across said top of said dividing wall between said topmost inlet openings.

2. The invention according to claim 1 wherein said dividing wall has an upper right tab extending laterally rightwardly from said dividing wall and engaging said right side wall of said water passage, an upper left tab extending laterally leftwardly from said dividing wall and engaging said left side wall of said water passage, a lower right tab extending laterally rightwardly from said dividing wall and engaging said right side wall of said water passage at a point spaced below said upper right tab, and a lower left tab extending laterally leftwardly from said dividing wall and engaging said left side wall of said water passage at a point spaced below said upper left tab.

3. The invention according to claim 2 wherein said upper right and left tabs engage said right and left side walls of said water passage, respectively, above the topmost of said water inlet openings.

4. The invention according to claim 3 wherein said tabs are force fit in said water passage to locate and secure said dividing wall therein.

5. The invention according to claim 4 wherein said dividing wall has a generally vertical leading edge engaging said front wall of said water passage and a generally vertical trailing edge engaging said rear wall of said water passage, and wherein one of said edges has a V-shaped pointed configuration compressed against the respective wall of said water passage and forming a seal therewith to provide said isolation between said right and left sets of water inlet openings.

6. The invention according to claim 5 wherein said dividing wall has a lower edge engaging said bottom wall of said water passage and having a V-shaped pointed configuration having a lower tip extending below said lower right and left tabs and compressed against said bottom of said water passage and forming a seal therewith to provide said isolation.

* * * * *